US008857624B1

(12) United States Patent
Preston et al.

(10) Patent No.: US 8,857,624 B1
(45) Date of Patent: Oct. 14, 2014

(54) LARGE AND SMALL DOCUMENT COMBINATION OPTIMIZATION FOR DOCUMENT SEQUENCING SYSTEM

(75) Inventors: Charles Preston, Orangevale, CA (US); Marc Fagan, Folsom, CA (US); Brett Flickner, Folsom, CA (US)

(73) Assignee: DST Output West, LLC, El Dorado Hills, CA (US)

( * ) Notice: Subject to any disclaimer, the term of this patent is extended or adjusted under 35 U.S.C. 154(b) by 101 days.

(21) Appl. No.: 13/452,416

(22) Filed: Apr. 20, 2012

Related U.S. Application Data

(62) Division of application No. 12/198,788, filed on Aug. 26, 2008, now Pat. No. 8,172,090.

(60) Provisional application No. 60/966,490, filed on Aug. 27, 2007.

(51) Int. Cl.
*B07C 5/00* (2006.01)

(52) U.S. Cl.
USPC ..... 209/552; 270/21.1

(58) Field of Classification Search
USPC ..... 209/552; 270/21.1; 700/223; 53/501
See application file for complete search history.

(56) References Cited

U.S. PATENT DOCUMENTS

| | | | | |
|---|---|---|---|---|
| 5,724,791 | A * | 3/1998 | Pishny et al. | 53/501 |
| 5,754,434 | A * | 5/1998 | Delfer et al. | 700/223 |
| 7,060,928 | B2 | 6/2006 | Jirsa | |
| 7,411,146 | B2 | 8/2008 | Hanson et al. | |
| 7,556,247 | B1 * | 7/2009 | Delfer et al. | 270/21.1 |
| 8,172,090 | B1 * | 5/2012 | Preston et al. | 209/552 |
| 2006/0080122 | A1 | 4/2006 | Klopsch et al. | |
| 2010/0049360 | A1 | 2/2010 | Stemmle | |

* cited by examiner

*Primary Examiner* — Terrell Matthews
(74) *Attorney, Agent, or Firm* — James M. Ritchey

(57) ABSTRACT

A system and method of sorting documents utilizing an algorithm or routine that alternates an order of documents with smallest sheet count documents followed by largest sheet count documents in order to optimizes a document throughput of an inserter based on a maximum speed that documents can be collated and accumulated and an algorithm or routine for optimizing the document throughput of a dual sheet cutter by grouping even sheet count documents together on evenly paired sheet boundaries within a mailing group of printed documents, with or without the use of dynamic motion control of the inserter.

8 Claims, 12 Drawing Sheets

LARGE AND SMALL DOCUMENT COMBINATION OPTIMIZATION FOR DOCUMENT SEQUENCING SYSTEM

CROSS-REFERENCE TO RELATED APPLICATIONS

This application is a division of U.S. patent application Ser. No. 12/198,788 filed on Aug. 26, 2008, now U.S. Pat. No. 8,172,090, incorporated herein by reference, which is a non-provisional of U.S. provisional patent application No. 60/966,490 filed on Aug. 27, 2007, incorporated herein by reference in its entirety. Priority is claimed to each of the foregoing patent applications.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

The subject invention relates to a method and system for rearranging documents within a logical group of a single stream or multiple streams of printed documents (frequently single to multi-page billing statements within a particular printing job). Small documents are paired with large documents for a logical group of documents that are mailed together. This arrangement (utilizing an appropriately designed sorting routine/algorithm) allows for greater inserting efficiencies and higher throughput of documents, thereby resulting in overall lower document preparation costs. More specifically, the operation of a mailing inserter is smoothed and made more efficient via utilization of large with small document combination optimization since the sortation algorithm alternates the order of documents with the smallest sheet count documents followed by the largest sheet count documents in order to optimize the throughput of an associated mail inserter based on the maximum speed that documents can be collated and accumulated in an associated collator/accumulator.

2. Description of Related Art

In the past, postal regulations have stipulated that in order to obtain the maximum discount for postage under a manifest mail agreement, that the documents must meet stringent requirements as outlined in the "Domestic Mail Manual" (DMM). Included in the DMM are requirements for the sorting of a group of documents destined to be mailed (a "mailing") by the United States Postal Service (USPS). In order for a bulk mailer to obtain the maximum discount, the mail must be sorted by the destination zip code, carrier route, and walk route order. Included in the requirement is that the sort order of the documents must be maintained throughout the mailing. Consequently, when the documents were placed in a mail tray for submission to the USPS, the sort order was to be maintained within the tray (see FIG. 1—PRIOR ART).

In a printing/mailing facility that prints and mails documents in accordance with DMM standards, in order to obtain postal discounts, the documents are typically printed on a continuous form printer on a continuous web of printable material. An example of this type of printer is the IBM InfoPrint 1332. While sorting can be performed after documents have been produced using a mail sorting machine, printing and inserting documents in the correct sort order offers business and process benefits.

Subsequent to printing, the continuous form paper is placed on a mail inserting machine (e.g., a Bowe Bell+Howell 3000) that cuts the paper, accumulates the cut paper into collated documents, and then inserts the accumulated documents into an envelope. Since the document may contain one to a plurality of sheets (with a total odd or even sheet count), the time it takes to accumulate the paper for a document varies in proportion to the number of sheets per document. While the document is accumulating, conventional inserters continue to cycle, thereby wasting time. This causes the inserters to be less efficient than possible since the inserter cycles at a speed higher than documents can be delivered to the inserter due to the varying sheet count. If there are a large number of low sheet count documents, the inserter may not be able to cycle fast enough to accept all of the documents, thus causing the document accumulator to be less efficient than possible.

On inserters with "dynamic motion control" (see U.S. Pat. No. 5,724,791, which is herein incorporated by reference) the mail inserter cycles at the optimal speed based on the number of sheets being accumulated in the document. A dynamic motion control system is utilized for decreasing wear and tear or mechanical degradation on an envelope inserting apparatus, thereby increasing the life of the envelope inserting apparatus. The envelope inserting apparatus or transferring means (transferring in the sense of taking the incoming documents and inserts from the moving means or folder, assembling the mail items, and transferring the mail items to any further processing equipment) is coupled to means for printing document packets which are moved to the inserting apparatus at variable intervals. More specifically, the dynamic motion control system is employed with an inserter machine that receives packets of documents having possibly different numbers of pages within each packet and each packet is inserted into a mailing envelope. The dynamic motion control system efficiently coordinates the operational speed of the inserter with the period of time required to print the document pages within each incoming packet (larger sheet count documents take more time than smaller sheet count documents to assemble and are more sensitive to being damaged during the envelope insertion process if moved too quickly), thereby both speeding up the insertion process and minimizing repairs to the inserter machine.

Large and Small Sheet Count Document Combinations:

A typical document handling/insertion system is depicted in FIG. 2 in which rolled web paper, having the desired documents printed upon it, is unwound, passed through a slitter, a cutter (position A in FIG. 2), a collator/accumulator (position B in FIG. 2), a folder (position C in FIG. 2), into a mail inserter, and finally into a receiving envelope (position D in FIG. 2). Because of the previous goal of maintaining the final postal sort sequence, when documents are produced on inserters the cycle speed of the inserter is not optimal for all document sets of varying sheet count. A small sheet count document requires little time to accumulate in the collator (position B in FIG. 2) out of the cutter (position A in FIG. 2) while large sheet count documents require relatively more time to accumulate. The inserter may be between cycles for small sheet count documents, while the inserter may cycle one or more times waiting for a large sheet count document, thereby wasting time and money.

Even and Odd Sheet Count Document Alignment:

Inserters using continuous form cutters (position A in FIG. 2) can utilize a double sheet cutter where two sheets are delivered in a single cut cycle when they are side-by-side on the web and part of the same document, a 100% throughput improvement over single sheet cut cycles. Using this type of cutter, odd sheet count documents always require the same number of cut cycles: $((N-1)\div 2)+1$ (where N is the number of sheets in a document) (FIG. 3). But even sheet count documents require either $(N\div 2)$ or $(N\div 2)\div 1$ cut cycles, depending on whether all the sheets are aligned side-by-side or not (FIG. 4).

If no consideration is made for even sheet count statement alignment, then up to half of them will require $(N\div 2)$ cut cycles and the rest $(N\div 2)+1$ cut cycles. This difference can have a significant impact on throughput. For example, a job of 10,000 documents where half are two sheets and half are three sheets would require 15,000 cut cycles if all two sheet documents were aligned side-by-side. Without side by side alignment, on average 17,500 cut cycles are required, a 16.7% increase.

Additionally, it is noted that USPTO Publication No.: 20060080122 (Klopsch, et al., Multi-print Stream Processing Module Optimizer for Document Processing) describes a document processing patent that optimizes the order of multiple print streams of documents comprising documents that are destined for processing on an inserter. The result is increased throughput on the inserter since the multiple cutters are preparing the documents concurrently. The subject invention differs in a major and critical way from the invention described in this publication since the subject optimization is to a single print stream, whereby each print stream is optimized individually and not across print streams. In addition, the sort algorithms employed in the subject invention are not like those in the Klopsch et al. publication in that the print streams are optimized without regard for individual mail unit rules since those rules no longer apply.

BRIEF SUMMARY OF THE INVENTION

An object of the present invention is to supply a document handling system and associated method of operation that optimizes a mail inserter for greater efficiencies at optimal speeds, thereby increasing the throughput of documents and decreasing the cost of each document.

Another object of the present invention is to provide a document handling system and associated method of operation that optimizes document sortation within a mail unit by sorting large sheet count documents paired with small sheet count documents.

Yet another object of the present invention is to describe a document handling system and associated method of operation that optimizes document sortation within a mail unit by first sorting large sheet count documents paired with small sheet count documents and then within this first order odd sheet documents are grouped together with even sheet count documents to enhance the speed through a mail inserter.

Yet still a further object of the subject invention is to provide a document handling system and associated method of operation that optimizes document sortation within a mail unit by first sorting large sheet count documents paired with small sheet count documents and then within this first order odd sheet documents are grouped together with even sheet count documents to enhance the speed through a mail inserter and additionally, a numeric value may be utilized for determining when to pair large and small sheet count documents together and when to simply align even and odd sheet count documents for optimal throughput in the cutter assembly.

Disclosed is a system and method that is utilized within a document preparation and mailing process that includes: printing documents of varying sheet count on a continuous web of paper; slitting the web of printed pages; cutting the slit web of printed pages into individual sheets; collating/accumulating the individual sheets into separate complete documents; folding the sheets within each complete document; and passing the folded documents through a mail inserter that, optionally, uses dynamic motion control to insert each folded document into a receiving envelope. Comprising the sortation algorithm or sortation routine is a program that alternates an order of documents with smallest sheet count documents followed by largest sheet count documents in order to optimizes a document throughput of an inserter based on a maximum speed that documents can be collated and accumulated and optimizes the document throughput of a dual sheet cutter by grouping even sheet count documents together on evenly paired sheet boundaries within a mailing group of printed documents, with or without the use of dynamic motion control of the inserter.

Additionally, the subject invention comprises a system and method of sorting documents combines an algorithm that alternates an order of documents with smallest sheet count documents followed by largest sheet count documents in order to optimizes the document throughput of the inserter based on a maximum speed that documents can be collated and accumulated and means for optimizing document throughput of the dual sheet cutter by grouping even sheet count documents together on evenly paired sheet boundaries within a mailing group of printed documents within a mailing group of produced documents based on an optimal "threshold" or "threshold value" of document sheet counts that utilizes an algorithm that alternates the order of documents with smallest sheet count documents followed by largest sheet count documents in order to optimizes the document throughput of the inserter based on the maximum speed that documents can be collated and accumulated to optimize the inserter document throughput or by grouping even sheet count documents together on evenly paired sheet boundaries within a mailing group of printed documents to optimize document throughput by the collator/accumulator.

The subject invention further comprises a plurality of paper input paths into the inserter. The plurality of paper paths either consist of splits of a document across paper paths or discrete documents across multiple paths. Each paper path utilizes an algorithm that alternates an order of documents with smallest sheet count documents followed by largest sheet count documents in order to optimize the document throughput of the inserter based on the maximum speed that documents can be collated and accumulated.

Further objects and aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS

The invention will be more fully understood by reference to the following drawings which are for illustrative purposes only:

FIGS. 8A, 8B, 8C, 8D, and 8E show a flow diagram describing the subject invention.

DETAILED DESCRIPTION OF THE INVENTION

Effective May 14, 2007, the USPS altered the rules regarding the sort order of documents in a USPS mail tray. Now, the documents only need to be sorted based on zip code for maximum postal discounts while applying other DMM specific rules for arranging mailings into mail trays. The result of this rule change is that the contents of an individual mail tray no longer need to be in a specific order. Taking advantage of this rule change, the subject invention now optimizes the sort order of the document to run optimally on inserters that run at a fixed cycle speeds and also on "dynamic motion controlled" inserters.

Figure 1:
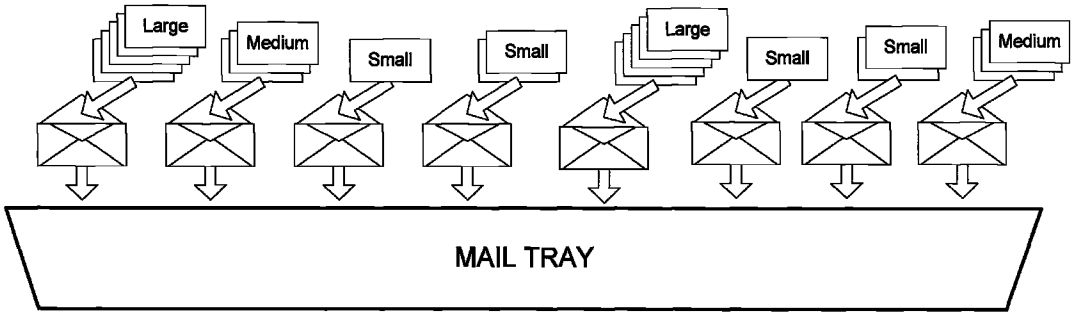
PRIOR ART FIGURE 1
FIG. 1 shows the PRIOR ART in which un-optimized documents (random even counts and odd counts) are sorted by zip code-carrier route in a mail tray.
Figure 2:
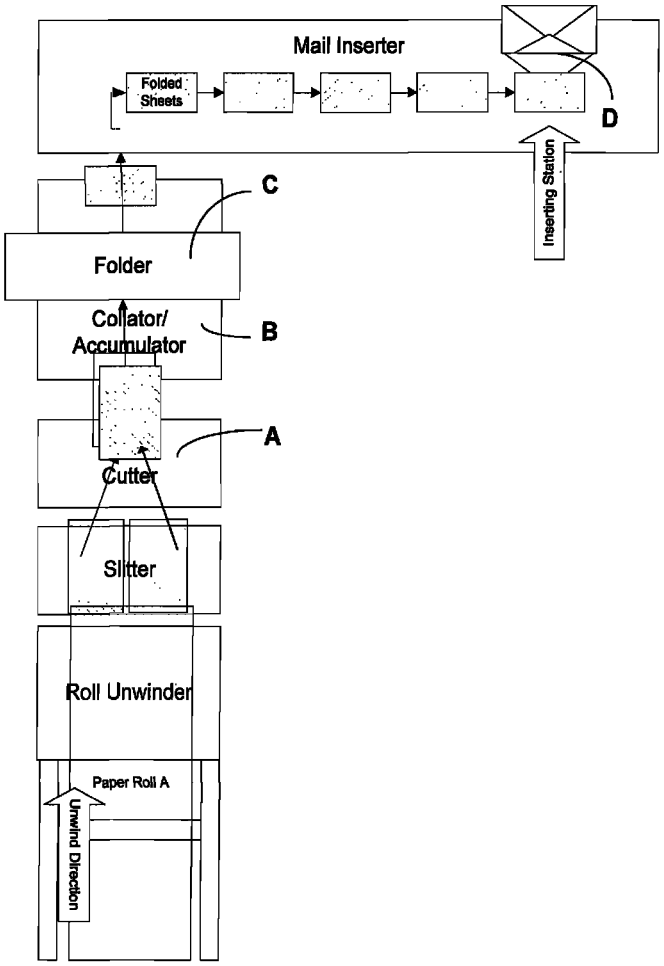
FIG. 2 shows a typical mail inserter block diagram.
Figure 3:
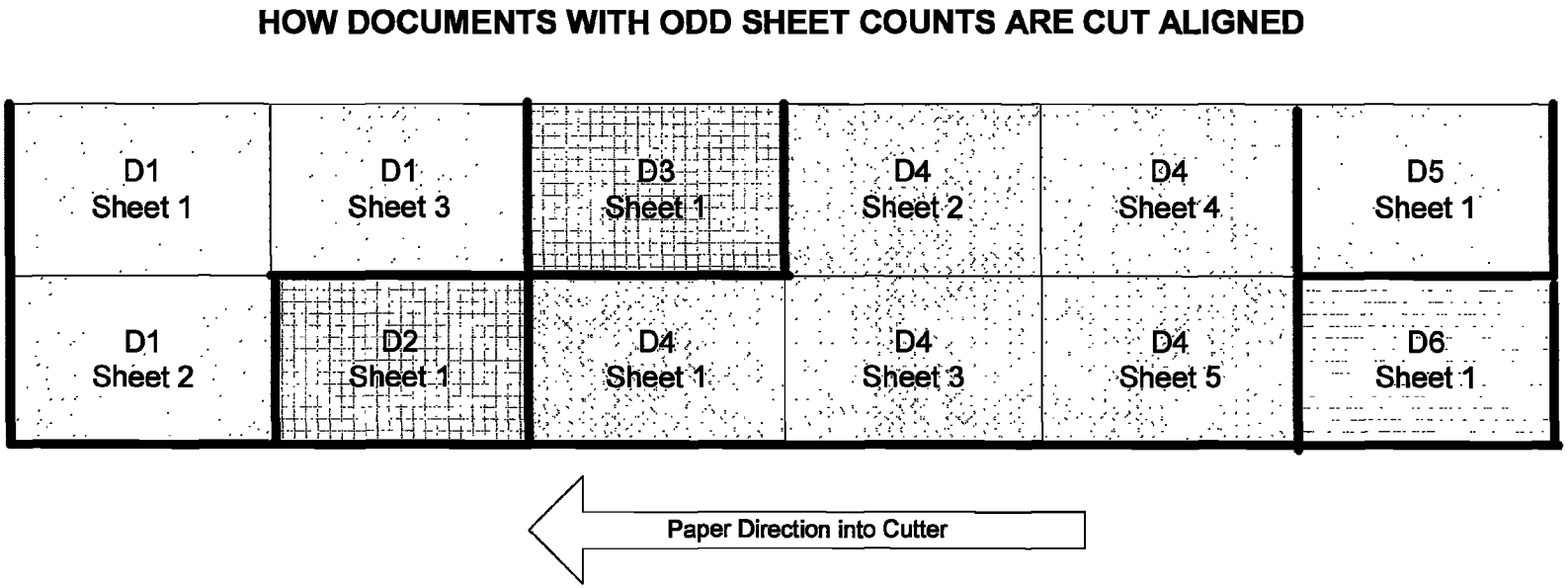
FIG. 3 shows how odd sheet count documents are cut aligned in a printed web of paper.
Figure 4:
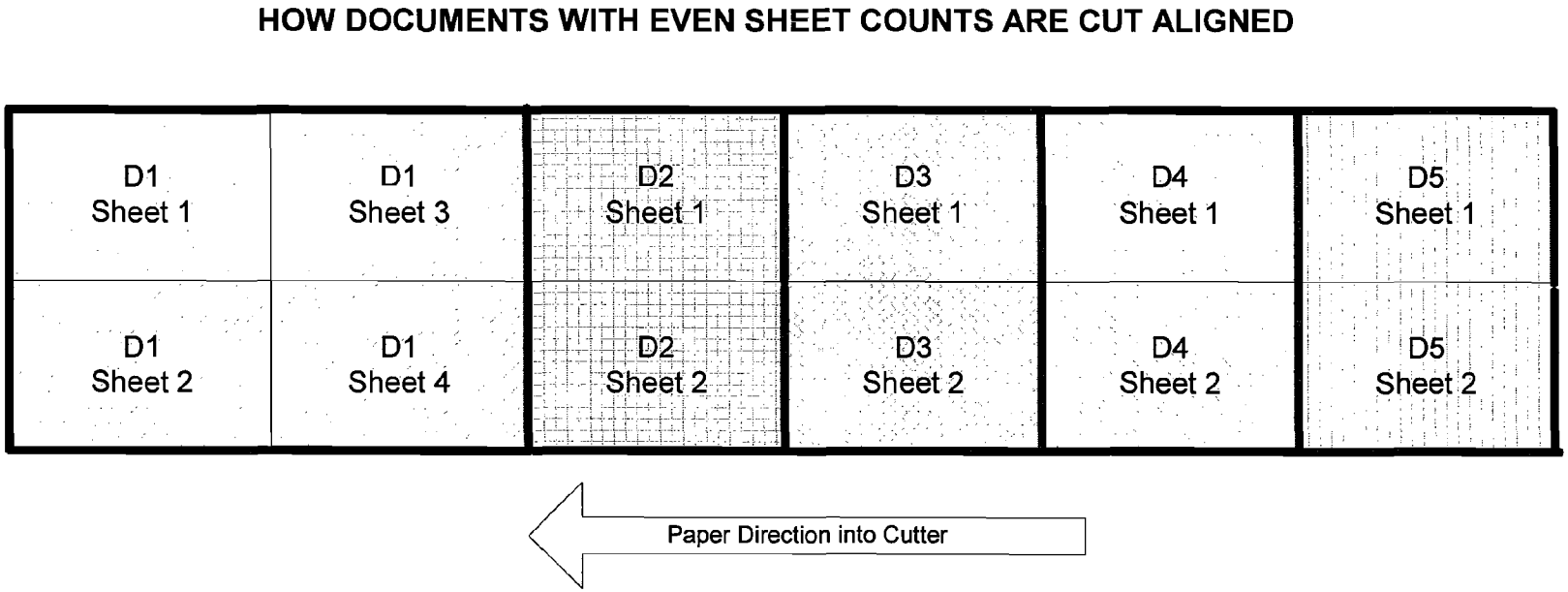
FIG. 4 depicts how even sheet count documents are cut aligned in a printed web of paper.
Figure 5:
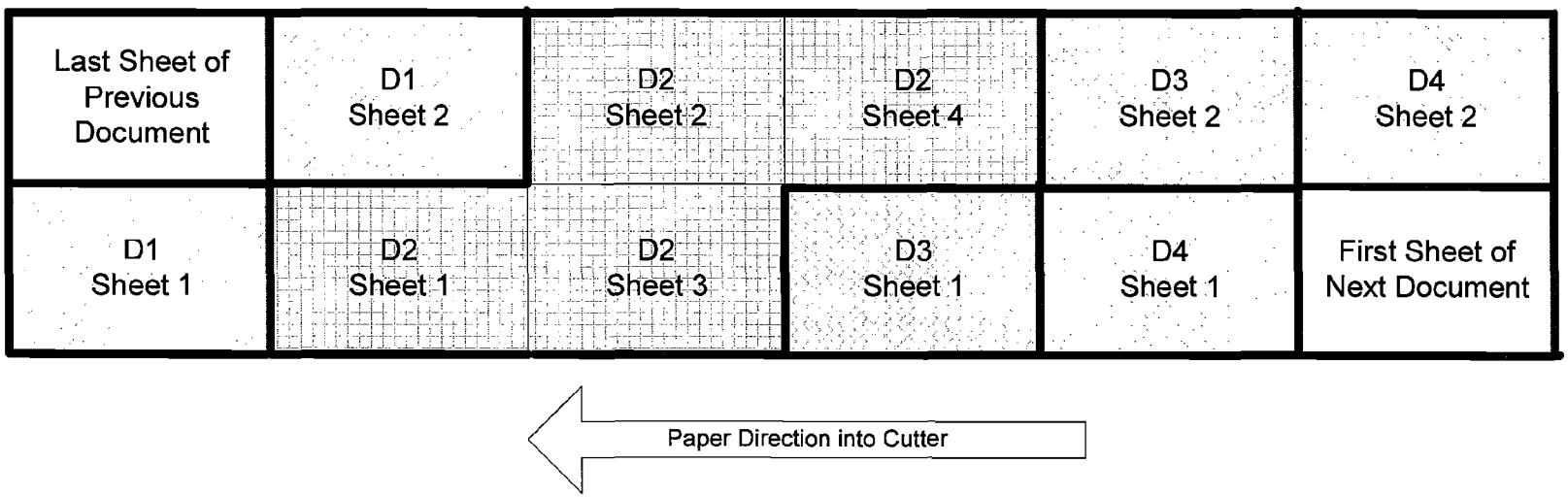
FIG. 5 illustrates how even sheet count documents are not cut aligned in a printed web of paper.
Figure 6:
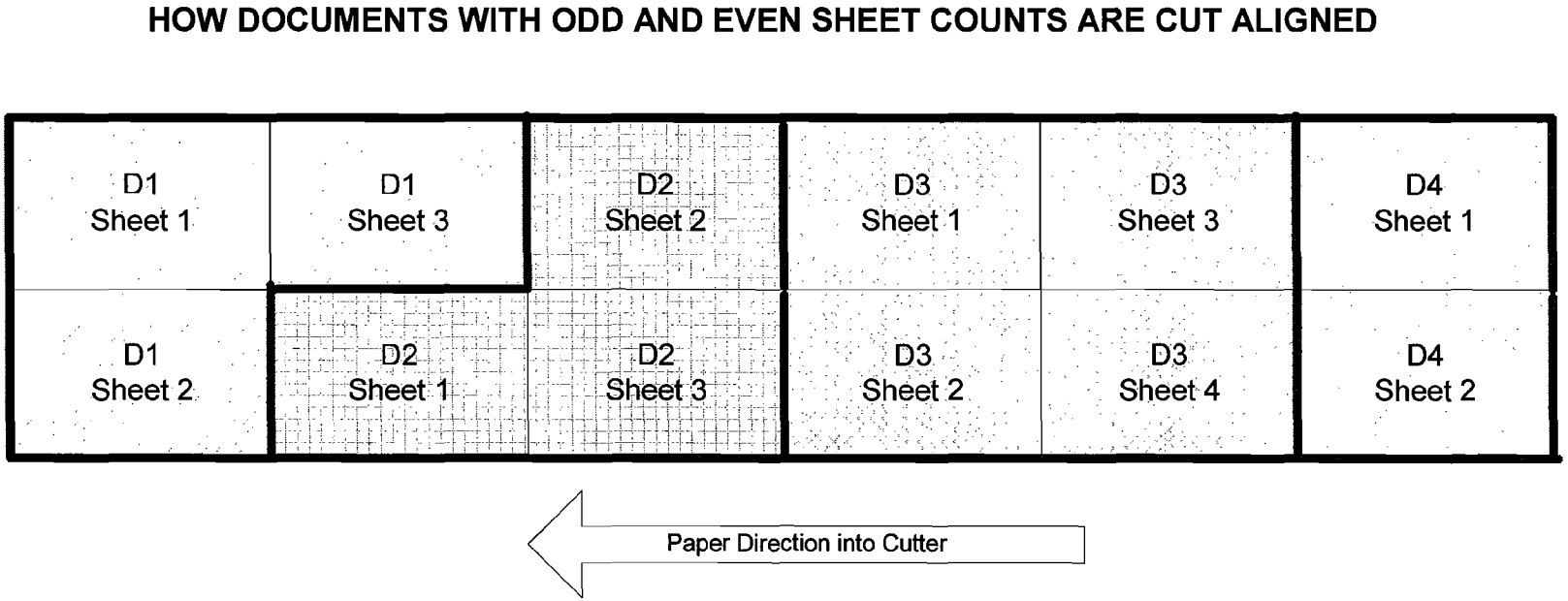
FIG. 6 shows how odd and even sheet count documents are cut aligned in a printed web of paper.
Figure 7:
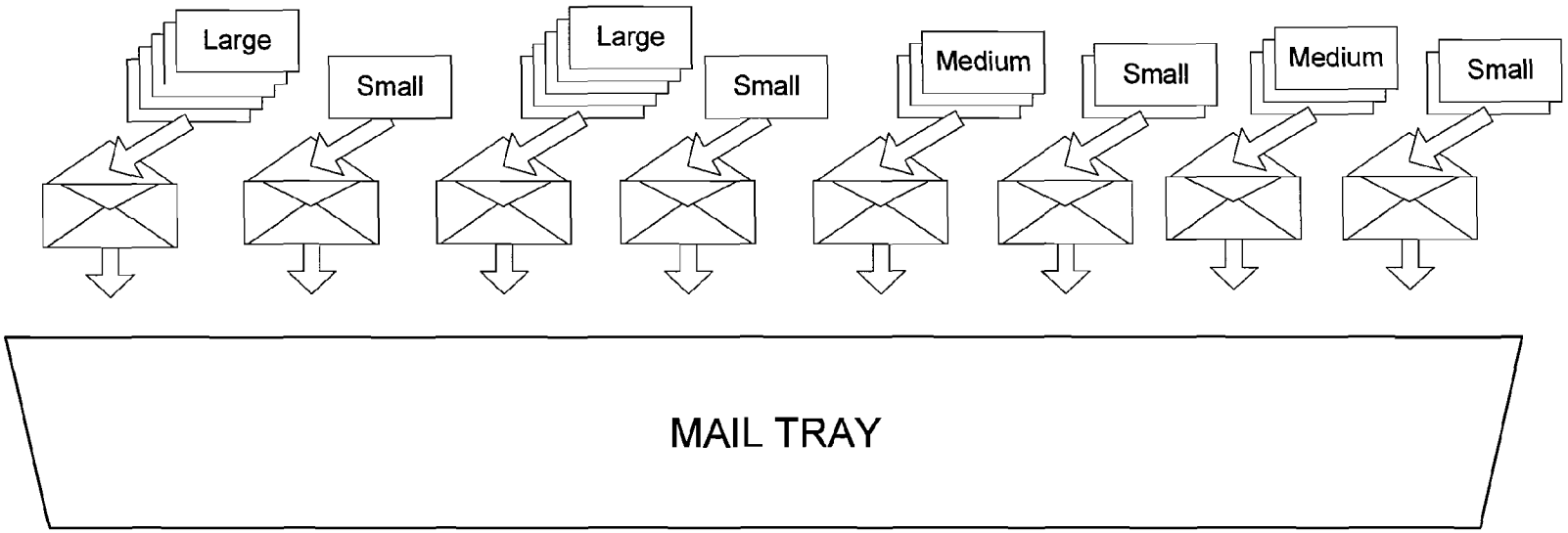
FIG. 7 shows optimized documents sorted by sheet count grouped in a mail tray (with zip code sorting for each mail trail too).

For the subject invention, the subject algorithm used to determine the sort order of the documents within a mailing group of document, in this case trays of mail, optimizes the inserter for greater efficiencies at optimal speeds, thereby increasing throughput and decreasing cost per document. This new sort order arranges the documents in a mail unit with large sheet count documents paired with small sheet count documents. Within this order, odd sheet count statements can be grouped together with even sheet count statements to enhance the speed through the inserter. Additionally, a numeric value can be used for determining when to pair large and small sheet count documents together and when to simply align even and odd sheet count documents (FIGS. 3-6) for optimal throughput in the cutter assembly. FIG. 7 shows an optimized mail tray based on sortation by sheet count (and zip codes, not shown).

The flow chart shown in FIGS. 8A, 8B, 8C, 8D, and 8E illustrates the steps utilized in the subject invention in which large sheet count and small sheet count documents are in a mail unit with odd and even alignment.

The effect of this novel sortation order of documents is twofold. First, the mail inserter cycles at the optimum speed for all of the statements, thereby increasing productivity in fixed speed insertion. Inserters using fixed speed cycling loose efficiency when the inserter cycles and the document collator/accumulator has not had enough time to complete the accumulation of that document. Empty track segments result in decreased overall throughput since a portion of the total run time of the inserter is lost. Another benefit of this constant speed is reduction in jams at the document inserter station and miss picked inserts since the inserter is cycling at a constant speed. Second, in aligning even sheet count statements with evenly paired sheet boundaries the number of required cut cycles by the associated cutter is reduced and the cutter throughput increases accordingly. The use of the subject invention results in reduced operation cost during document insertion operations through optimized throughput of paper, and the reduction of damaged documents on an inserter, thereby decreasing production costs and quality errors.

Additionally, a benefit of large-to-small document sortation depends on a buffer that momentarily slows down the small sheet count documents, thereby producing a document stream that "appears" to the inserter as a medium-to-medium sheet count document stream. The algorithm starts off each tray with the largest/smallest, then next largest/next smallest, and so on, so the beginning of the tray "appears" to the inserter as "virtually" medium-to-medium sheet counts, which is approximately equivalent to the statement rate at the end of the tray, which is "actually" medium-to-medium sheet counts (or close to medium-to-medium). The smooth operation of the inserter from one end of the tray to the other, despite the variation in document size, is a clear operational benefit of the subject invention. Another value lies in the fact that small sheet count documents can be kicked behind large sheet count documents faster than they could if no buffer existed (i.e., a small sheet count document could be kicked as if the inserter could run at 15,000 cycles per hour, but if it is paired with a large sheet count document produced at an equivalent 5,000 per hour rate, an inserter with a top speed of only 10,000 cycles per hour could process as much work as a 15,000 cycle per hour inserter with no buffer and no large-to-small sortation).

As indicated above, FIGS. 8A through 8E illustrate an exemplary sortation algorithm/routine for implementing the subject invention. The subject process begins in FIG. 8A in which the print job starts 5, proceeds on to "ALIGN=TRUE" 10, and then to "Read threshold value" 15 (optimal "threshold" or "threshold number" or "threshold value" of document sheet counts). It is noted that the "threshold" (in any of its uses herein) refers to a mechanical constraint of the machine, beyond which it is not possible to realize both ODD/EVEN and LARGE/SMALL advantages. In such cases the ODD/EVEN advantage is forfeited. Specifically, if the number of sheets in a statement pair is below the threshold number, the collator will not be able to kick the statements out as fast as the cutter can put them in, so there's no reason for the cutter to try to put them in faster by lowering the number of cuts. The LARGE/SMALL advantage still exists, however, and is attempted. The "threshold value" depends on variables such as maximum inserter speed, so it might be one value for a certain type of inserter and another value for another type of inserter. The range for a typical threshold value is usually from about 4 to about 20, which would account for inserters with top speeds between about 3,000 and 30,000 cycles per hour.

After the threshold value is read, the routine then moves on to "Load a new unit (tray) of documents" 20 and to the decision of "All documents are ODD or EVEN sheet count?" 25. A "YES" at step 25 results in progressing to "Group smallest with largest sheet count documents" 30 and the question "All documents in mail unit done?" 35, if "NO" then back to step 30 or if "YES" on to ask "Were the total number of sheets in work unit ODD count?" 40. A "NO" at step 40 moves on to the question of "Any mail units remaining?" 45 with a "YES" proceeding to loop back to step 20 and a "NO" leading to "Stop print job" 50. A "YES" as step 40 moves the process on to "Toggle ALIGN" and then to step 45.

Should step 25 yield a "NO", the routine proceeds on to ask "Is ALIGN=TRUE?" 60 with a "YES" answer leading on to "Is there only one ODD sheet count document left? 65. The answer of "YES" for step 65 move the process on to "Group smallest with largest EVEN sheet count documents" 70 and then the query of "All EVEN documents in mail unit done?" 75. A "NO" at step 75 loops the subject process back to step 70, while a "YES" moves the process on to "select the remaining ODD sheet count documents in the mail unit" 80 and then to previously mentioned step 55.

Figure 8A:
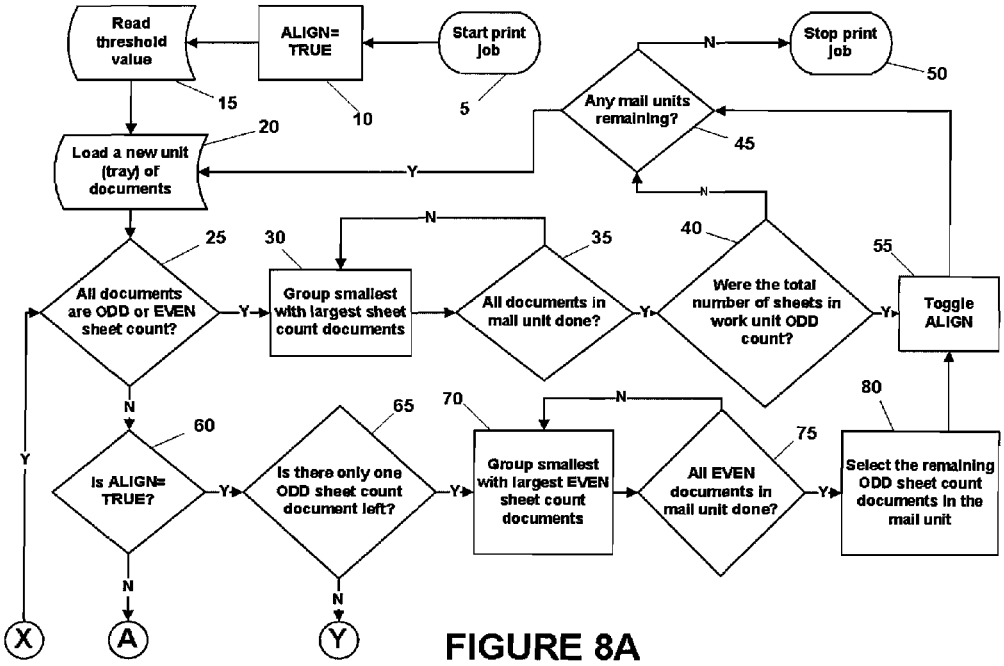
Figure 8B:
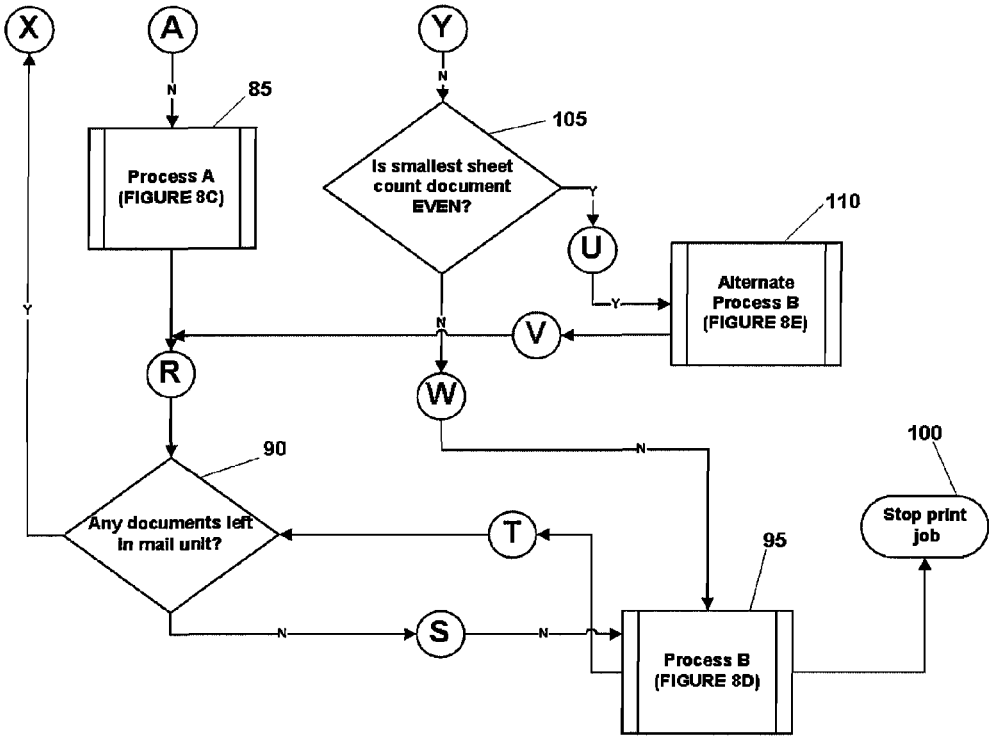
Figure 8C:
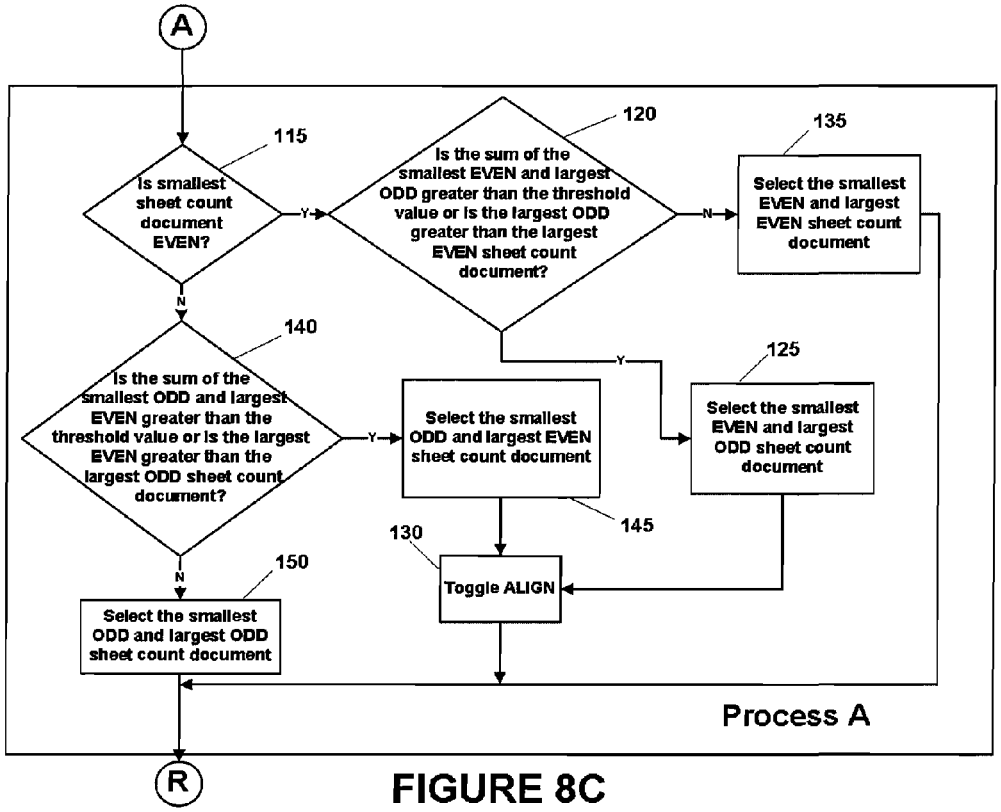
Figure 8D:
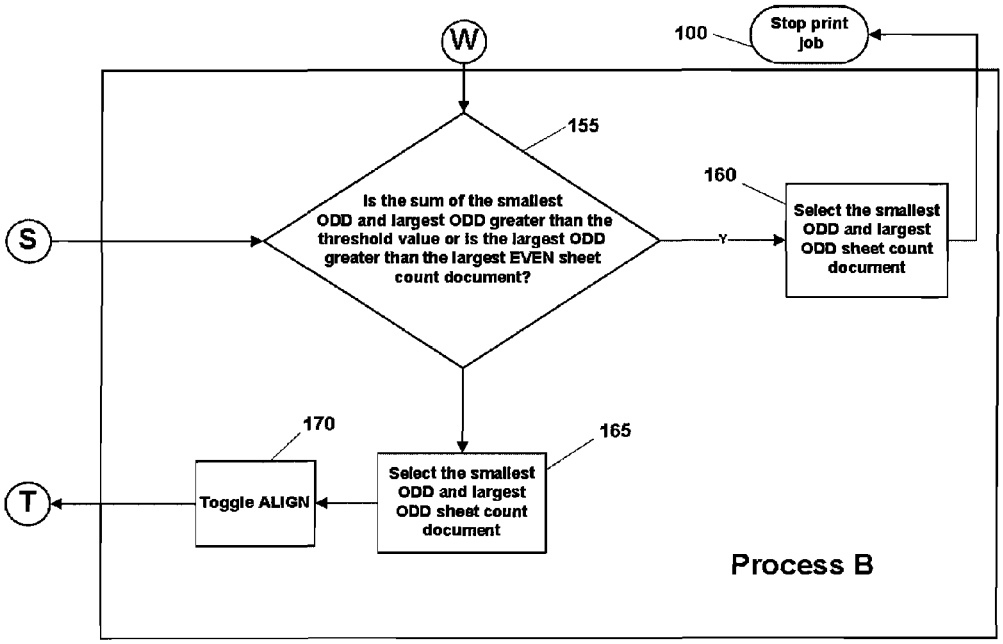

Should a "NO" result at either step 60 or step 65 the subject routine proceeds on to actions and questions shown in FIG. 8B. Specifically, if step 60 yields a "NO" then "Process A" 85 occurs (depicted in FIG. 8C) and the on to a decision of "Any documents left in mail unit" 90. A "YES" at step 90 loops the routine back to step 25 (FIG. 8A) and a "NO" moves the routine on to "Process B" 95 (shown in FIG. 8D).

Figure 8E:
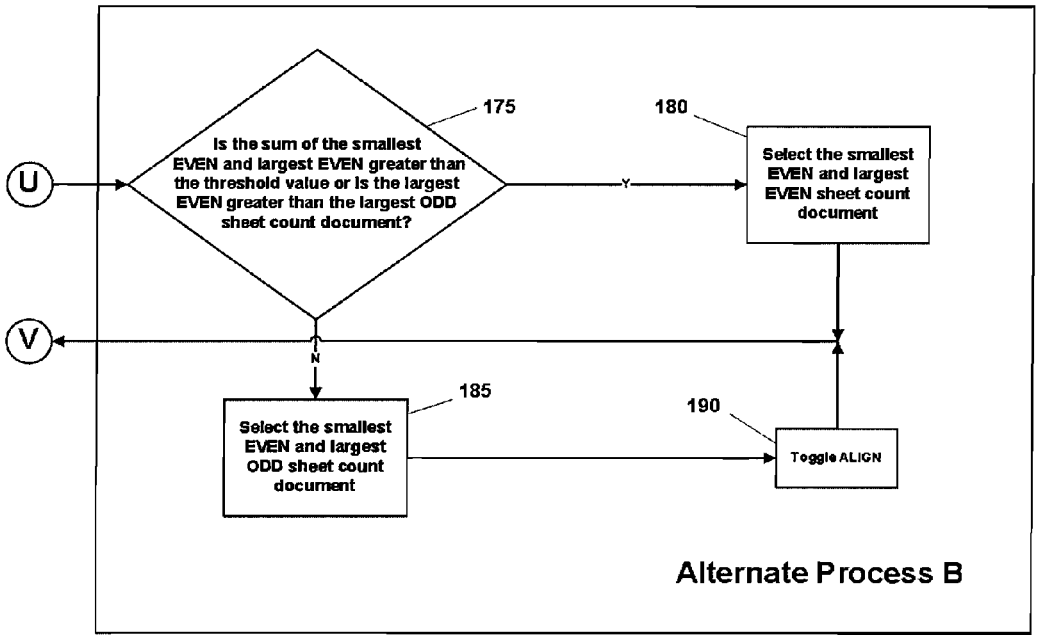

If step 65 yields a "NO" then the question is asked "Is smallest sheet count document EVEN?" 105 with a "NO" moving the algorithm to "Process B" 95 (outlined in FIG. 8D) and a "YES" proceeding to "Alternate Process B" 110 (shown in FIG. 8E).

As indicated, "Process A" 85 (FIG. 8C) begins with the query "Is smallest sheet count document EVEN?" 115. A "YES" at step 115 move the process on to ask "Is the sum of the smallest EVEN and largest ODD greater than the threshold value or us the largest ODD greater than the largest EVEN sheet count document?" 120. A "YES" at step 120 directs the process to "Select the smallest EVEN and largest ODD sheet count document" 125, then to "Toggle ALIGN" 130, and then to exit "Process A" 85 at figure linking symbol "R". A "NO" at step 120 directs the process to "Select the smallest EVEN and largest EVEN sheet count document" 135 and then on to exit "Process A" 85 at figure linking symbol "R". A "NO" at step 115 proceeds to question "Is the sum of the smallest ODD and largest EVEN greater than the threshold value of is the largest EVEN greater than the largest ODD sheet count document?" 140. A "YES" for step 140 guides the process on to "Select the smallest ODD and largest EVEN sheet count document" 145, then to step 130, and then on to exit "Process A" 85 at figure linking symbol "R".

As noted, "Process B" 95 (FIG. 8D) is relied upon when a "NO" results at step 105 (a figure connection is shown via linking symbol "W"). In "process B" 95 the question is asked "Is the sum of the smallest ODD and largest ODD greater than the threshold value or is the largest ODD greater than the largest EVEN sheet count document?" 155 with a "YES" moving the process to "Select the smallest ODD and largest ODD sheet count document" 160 and then on to "Stop print job" 100. A "NO" at step 155 leads to "Select the smallest ODD and largest ODD sheet count document" 165, then to "Toggle ALIGN" 170 and an exit to the question "Any document left in mail unit?" 90. A "YES" at step 90 loops the process back to step 25, while a "NO" at step 90 moves the process back to "Process B" 95.

As stated, "Alternate Process B" 110 is presented in FIG. 8E. A "YES" for step 105 leads to "Alternate Process B" 110 (via figure linking symbol "U") and the query "Is the sum of the smallest EVEN and largest EVEN greater than the threshold value or is the largest EVEN greater than the largest ODD sheet count document?" 175. A "YES" leads to "Select the smallest EVEN and largest EVEN sheet count document" 10 and then an exit from "Alternate Process B" 95. A "NO" goes to "Select the smallest EVEN and largest ODD sheet count document" 185, then to "Toggle ALIGN" 190, and then an exit from "Alternate Process B" 95. Clearly, "Alternate Process B" 95 exits and returns to the remainder of the subject routine via figure linking symbol "V" and ties into previously discussed step 90.

It is stressed that multiple paper paths may be employed with the subject invention. One paper path is utilized in the associated figures for exemplary purposes only and not by way of limitation. Multiple paper input paths, for 2 to N paper path input paths into the inserter, may be utilized and the paper paths can be splits of a document across paper paths or discrete documents across paths, wherein each paper path utilizes an algorithm that alternates the order of documents with smallest sheet count documents followed by largest sheet count documents in order to optimizes the throughput of the inserter based on the maximum speed that documents can be collated and accumulated.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device, system, or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. For use with a document handling system that includes a continuous web of paper, a printer, a web slitter, a web cutter, a sheet collator/accumulator, a sheet folder, and mail inserter, a document sortation system utilizing an algorithm that alternates an order of printing documents on the continuous web with smallest sheet count documents followed by largest sheet count documents in order to optimizes a document throughput of the inserter based on a maximum speed that documents can be collated and accumulated, further comprising means for optimizing said document throughput of a dual sheet cutter utilized as the web cutter by grouping even sheet count documents together on evenly paired sheet boundaries within a mailing group of printed documents.

2. A document sortation system according to claim 1 wherein the system combines an algorithm that alternates an order of documents with smallest sheet count documents followed by largest sheet count documents in order to optimizes said document throughput of the inserter based on a maximum speed that documents can be collated and accumulated and means for optimizing document throughput of the dual sheet cutter selected from a group consisting of:

a) grouping even sheet count documents together on evenly paired sheet boundaries within a mailing group of printed documents within a mailing group of produced documents based on an optimal threshold of document sheet counts that utilizes an algorithm that alternates the order of documents with smallest sheet count documents followed by largest sheet count documents in order to optimizes said document throughput of the inserter based on the maximum speed that documents can be collated and accumulated to optimize the inserter document throughput and b) grouping even sheet count documents together on evenly paired sheet boundaries within a mailing group of printed documents to optimize document throughput by the collator/accumulator.

3. A document sortation system according to claim 1, further comprising a plurality of paper input paths into the inserter are utilized, wherein said plurality of paper paths are selected from a group consisting of splits of a document across paper paths and discrete documents across multiple paths, wherein each said paper path utilizes an algorithm that alternates an order of documents with smallest sheet count documents followed by largest sheet count documents in order to optimizes said document throughput of the inserter based on the maximum speed that documents can be collated and accumulated.

4. A document sortation system according to claim 2, further comprising a plurality of inserter paper input paths into the inserter are utilized, wherein said plurality of paper paths are selected from a group consisting of a document across said paper paths and discrete documents across said paths, wherein each said paper path utilizes an algorithm that alternates the order of documents with smallest sheet count documents followed by largest sheet count documents in order to optimizes the throughput of an inserter based on a maximum speed that documents can be collated and accumulated and means for optimizing the throughput of a dual sheet cutter selected from a group consisting of:

a. grouping even sheet count documents together on evenly paired sheet boundaries within a mailing group of printed documents within a mailing group of produced documents based on an optimal threshold of document sheet counts that utilizes an algorithm that alternates the order of documents with smallest sheet count documents followed by largest sheet count documents in order to optimizes the throughput of an inserter based on the maximum speed that documents can be collated and accumulated to optimize inserter throughput and b. grouping even sheet count documents together on evenly paired sheet boundaries within a mailing group of printed documents to optimize document collator/accumulator throughput.

5. A document sortation system according to claim 1, further comprising the use of dynamic motion control.

6. A document sortation system according to claim 2, further comprising the use of dynamic motion control.

7. A document sortation system according to claim 3, further comprising the use of dynamic motion control.

8. A document sortation system according to claim 4, further comprising the use of dynamic motion control.

* * * * *